US006161221A

United States Patent [19]

Hochmuth

[11] Patent Number: 6,161,221

[45] Date of Patent: Dec. 19, 2000

[54] GOALKEEPER'S GLOVE WITH A LATEX LAYER

[76] Inventor: Peter Hochmuth, Weissenburger Strasse 19, D-91757 Treuchtlingen, Germany

[21] Appl. No.: 09/442,428

[22] Filed: Nov. 17, 1999

[30] Foreign Application Priority Data

Nov. 24, 1998 [DE] Germany ..... 298 20 998 U

[51] Int. Cl.[7] ..... A41D 19/00

[52] U.S. Cl. ..... 2/161.1; 2/167

[58] Field of Search ..... 2/16, 20, 159, 2/161.6, 161.7, 161.8, 163, 167, 169, 168, 161.1

[56] References Cited

U.S. PATENT DOCUMENTS 5,138,719 8/1992 Orlianges et al. ..... 2/168

5,200,263 4/1993 Gould et al. ..... 428/247

5,336,555 8/1994 Darras et al. ..... 428/247

*Primary Examiner*—John J. Calvert

*Assistant Examiner*—Katherine Moran

*Attorney, Agent, or Firm*—Brown & Wood, LLP

[57] ABSTRACT

A goalkeeper's glove included up and inner hand portions, and a latex covering, at least regionwise, the inner hand portion, with an outer surface of the latex layer forming an outer surface of the inner hand portion, with the latex layer being formed of a soft and foamy material in which carbon particles, having a form of one of carbon fibers and small carbon platelets, are distributed, and with at least some of the carbon particles being visible on the outer surface of the latex layer.

1 Claim, 1 Drawing Sheet

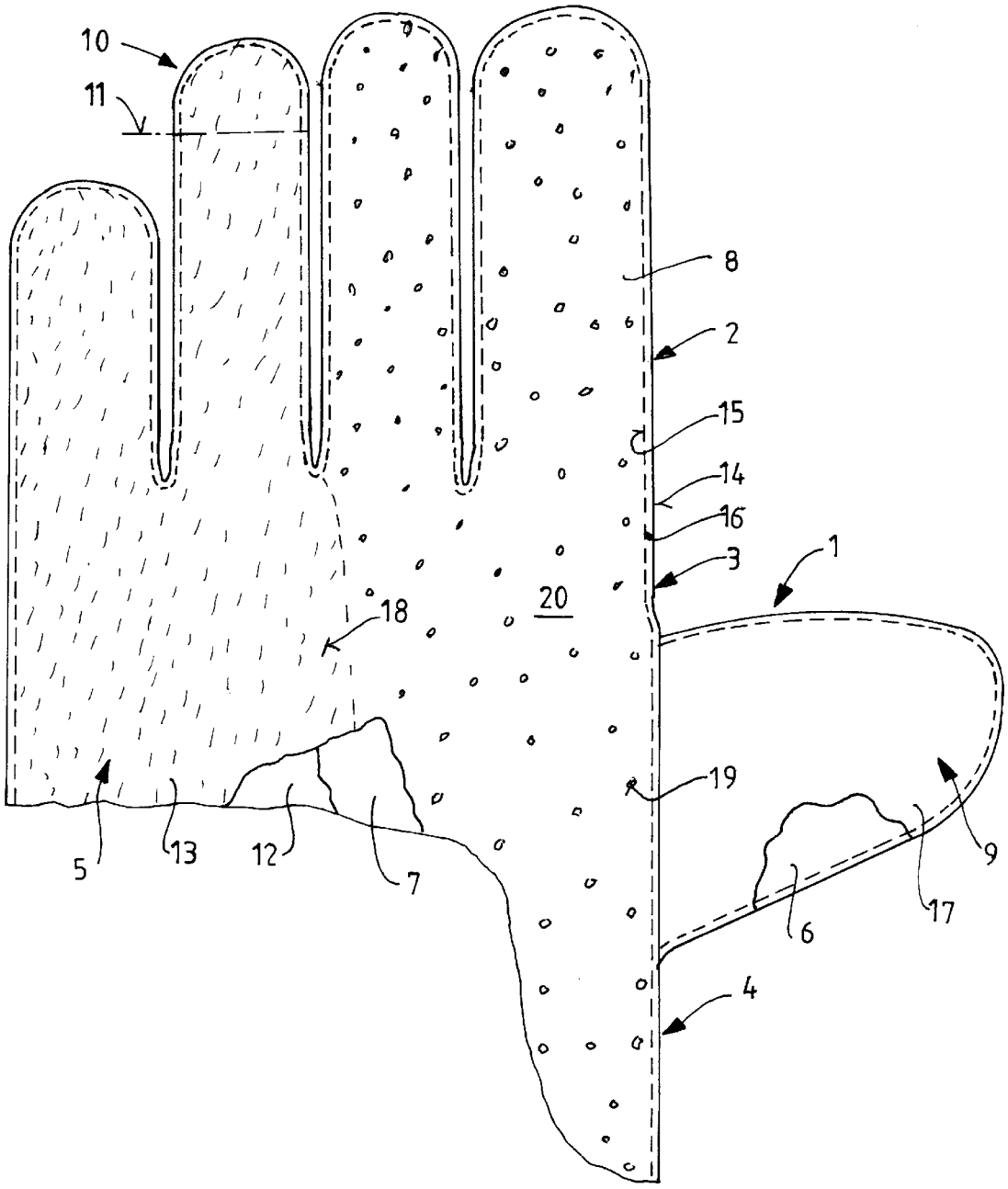
10
11
8
2
15
14
16
3
1
20
18
19
5
13
12
7
9
17
6
4

GOALKEEPER'S GLOVE WITH A LATEX LAYER

BACKGROUND OF THE INVENTION

1. Field of the Invention

The present invention relates to a goalkeeper's glove including upper and inner hand portions, and a latex layer covering, at least regionwise, the inner hand portion, with an outer surface of the latex layer forming an outer surface of the inner hand portion, and with the latex layer being formed of a soft and foamy material.

2. Description of the Prior Art

A goalkeeper's glove of the type described above is disclosed in the German Publication DE 296 00 843. In the known goalkeeper's glove, the latex layer or coating, which covers the inner hand portion, extends over the entire surface of the inner hand portion. However, the latex layer can also cover only a portion of the surface of the inner hand portion. However, the latex layer can cover only a portion of the surface of the inner hand portion and or separate regions of the upper hand portion of the glove. The latex layer is subjected to the force applied by balls which the goalkeeper tries to ward off. Therefore, the latex layer is subjected to high loads. Here, latex is understood to be a soft and whitish cautchouc or rubber produced from natural latex sap. Due to the softness of the material of the latex layer, the glove has an improved grip on a ball which, of course, is highly desirable. However, the softness of the latex layer, which is formed of a pure latex material, leads to a relatively high wear of the latex layer. Therefore, with frequent use, the latex layer rapidly wears out.

Accordingly, an object of the present invention is to provide a goalkeeper's glove of a type described above the latex layer of which would have an improved wear resistance, while retaining the necessary softness.

SUMMARY OF THE INVENTION

This and other effects of the present invention, which will become apparent hereinafter, are achieved by providing a latex layer formed of a material in which carbon particles, having a form of one of carbon fibers and small carbon platelets, are distributed, with at least some of the carbon particles being visible on the outer surface of the latex layer.

The distributed carbon particles do not affect the softness of the latex layer while increasing the wear resistance of the latex layer. This increases the useful life of the latex layer and, thus, of the glove itself. Generally, the platelets have a uniform shape, whereas the fibers have a somewhat elongate form. The carbon fibers and graphite platelets are, per se, well known. The carbon particles noticeably protrude from the whitish latex layer.

It is particularly advantageous and preferable when the latex material contains from about 0.5 to 5% by weight of the carbon particles. This proportion provides a suitable quantity of carbon particles in a goalkeeper's glove. With this proportion, from 95 to 99.5% by weight of latex material is formed of pure latex. It is not recommended to increase the carbon particle content above 5% by weight, as an increased quantity of the carbon particle can adversely affect the soft, foamy, i.e., porous condition of the latex layer.

The platelet can have, e.g., a diameter of up to 1 mm. The fibers, as a rule, have a length up to 2 mm.

The novel features of the present invention, which are considered as characteristic for the invention, are set forth in particular in the appended claims. The invention itself, however, both as to its construction and its mode of operation, together with additional advantage and objects thereof, will be best understood from the following detailed description of preferred embodiments, when read with reference to the accompanying drawings.

BRIEF DESCRIPTION OF THE DRAWINGS

Single FIGURE of the drawings shows a plan view of a portion of a goalkeeper's glove with a latex layer according to the present invention.

DETAILED DESCRIPTION OF THE PREFERRED EMBODIMENT

A goalkeeper's glove, which is shown in the drawing, has a thumb region 1, four front finger regions 2, a hand region 3, and a wrist region 4. An upper hand portion 7 is formed as a one-piece member and forms an upper wrist region, an upper hand region and four upper finger regions. As shown in the drawing, the upper hand portion 7 is located beneath an inner hand portion 5 which forms an inner hand region, four front inner finger regions 8, and an inner thumb region 9. A front tip of each front finger region 2 and of the thumb region 3 is designated with a dash line 11. The inner hand portion 5 includes a carrier layer 12 with an outwardly facing latex layer 13. The four front regions 2 and the thumb region 1 are sewed along their longitudinal edges 14 with seams 15, whereby bead-like seam join 16 are formed. Further, the inner thumb region 9 has a later layer 17 covering its carrier layer 6.

The latex layers 13 and 17 completely cover the surface of the inner hand portion. The latex layer 13 is interspersed with carbon particles 18 in form of carbon fibers or with carbon particles 19 in form of small graphite platelets. The drawing shows both forms of the graphite inclusions. However, as a rule, the latex layer includes only one form of the graphite inclusions. The carbon particles or platelets 18, 19 are visible on an outer surface 20 of the latex layer 13. The latex layer 17 of the inner thumb region 9 is free from carbon inclusion, though it also can contain carbon inclusions.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A goalkeeper's glove, comprising an upper hand portion; an inner hand portion; and a latex layer covering, at least regionwise, the inner hand portion, with an outer surface of the latex layer forming an outer surface of the inner hand portion, the latex layer being formed of a soft and foamy material in which carbon particles, having a form of one of carbon fibers and small carbon platelets, are distributed, with at least some of the carbon particles being visible on the outer surface of the latex layer, wherein the latex material includes from about 0.5 to 5% by weight of carbon particles.

* * * * *